US005460528A

United States Patent [19]

Wentworth

[11] Patent Number: 5,460,528

[45] Date of Patent: Oct. 24, 1995

[54] STARLIGHT AND MOONLIGHT HYBRID SIMULATION USING FIBER OPTICS

[75] Inventor: Edwin W. Wentworth, Dale City, Va.

[73] Assignee: The United States of America as represented by the Secretary of the Army, Washington, D.C.

[21] Appl. No.: 245,136

[22] Filed: May 17, 1994

[51] Int. Cl.[6] ..... F41G 3/26

[52] U.S. Cl. ..... 434/19; 434/42; 434/286; 385/115

[58] Field of Search ..... 434/19, 16, 11, 434/21, 22, 36, 41, 42, 111, 286, 285, 284, 288, 290; 385/115

[56] References Cited

U.S. PATENT DOCUMENTS

| | | | |
|---|---|---|---|
| 3,327,712 | 6/1967 | Kaufman et al. | 385/115 |
| 3,470,629 | 10/1969 | Kittredge et al. | 434/286 |
| 3,761,156 | 9/1973 | Mohon et al. | 434/42 |
| 3,903,615 | 9/1975 | Dotsko | 434/42 |
| 4,065,859 | 1/1978 | Mecklenborg | 434/42 |
| 4,172,631 | 10/1979 | Yevick | 385/115 |
| 4,203,232 | 5/1980 | Knight et al. | 434/16 |
| 4,310,974 | 1/1982 | Gdovin et al. | 434/42 |
| 4,483,585 | 11/1984 | Takami | 385/115 |
| 4,776,666 | 10/1988 | Kuehn et al. | 434/286 |
| 5,066,085 | 11/1991 | Gimbutas et al. | 385/115 |
| 5,369,721 | 11/1994 | Conti | 385/115 |
| 5,380,204 | 1/1995 | Decker | 434/36 |

FOREIGN PATENT DOCUMENTS

| | | | |
|---|---|---|---|
| 259687 | 6/1990 | Japan | 434/286 |
| 746696 | 7/1980 | U.S.S.R. | 434/286 |
| 1164774 | 6/1985 | U.S.S.R. | 434/286 |
| 2234086 | 1/1991 | United Kingdom | 385/115 |

*Primary Examiner*—Robert A. Hafer
*Assistant Examiner*—Michael O'Neill
*Attorney, Agent, or Firm*—Milton W. Lee; Alain L. Bashore; Anthony T. Lane

[57] ABSTRACT

A hybrid simulation system that provides realistic indoor starlight and moonlight simulation. At least two light sources provides light where each is coupled to an aperture so that the light source is focused. At least one variable aperture control is provided for one of the apertures so that variability of that aperture area size can be performed. Fiber optic bundles coupled for each aperture which receives the focused light where each bundle contains at least one fiber optic which provides a light conduit. Each bundle is coupled to an overhead position so that there is directed in a substantially downward direction from the overhead position the bundle. The area is illuminated with a simulated constant starlight and a simulated moonlight that may be varied by varying aperture size.

1 Claim, 5 Drawing Sheets

STARLIGHT AND MOONLIGHT HYBRID SIMULATION USING FIBER OPTICS

BACKGROUND OF THE INVENTION

1. Field of the Invention

The present invention generally relates to night time hybrid simulation systems and techniques, and more specifically, to indoor starlight and moonlight simulation systems and techniques for use with image intensifier devices.

2. Description of Prior Art

Simulation techniques and systems that provides more realism in the testing and training of increasingly complex systems utilized in the field is continually desired. Simulation may yield evaluation of systems while they are still in the design stage to allow optimization of the design process. Training performance can be enhanced and evaluated for many types of situations without the cost or danger of a real test.

Simulation in the field is the most desirable since less variables need to be simulated to provide a realistic and meaningful results. A field simulation unfortunately requires tremendous logistics problems, is expensive; and in the case of testing systems that include a weapon, dangerous. Computer simulation is the least expensive, but as to what meaningful results are obtained from a computer printout, is debated. The computer is limited to only the data that is utilized in its calculation, which may not be relevant to the desired field. It is in the area of hybrid simulation, where there is a mix of both a controlled environment (as the field) and computer enhancements.

Hybrid simulation for the testing of image intensifiers ($I^2$), such as night vision goggles, is a specific area were development is ongoing. Much of the current simulation technology results in imagery that is realistic when viewed by the naked eye, but not realistic when viewed through night vision goggles since the $I^2$ device is frequency dependent. Indoor light sources utilized would provide light in both the visible and infrared spectrum range, but when filament voltages were varied to provide different light levels there is a corresponding unrealistic change in color temperatures and thus in frequency. The light sources were usually nothing more that an inclosed set of bulbs that would give off strange shadows on a target. When using an actual $I^2$ device in the field there are tremendous difficulties that result from the myriad of complex shadows in the field, so it becomes difficult to recognize what is being seen.

While the prior art has reported using simulation techniques and systems none have established a basis for a specific apparatus that is dedicated to the task of resolving the particular problem at hand.

What is needed in this instance is a hybrid simulation technique and system that provides indoor starlight and moonlight simulation as seen with an image intensifier device.

SUMMARY OF THE INVENTION

It is therefore one object of the invention to provide a hybrid simulation technique and system that provides realistic indoor starlight and moonlight simulation as seen with an image intensifier device.

According to the invention, a hybrid simulation system that provides realistic indoor starlight and moonlight simulation is disclosed. At least two light sources provides light where each is coupled to an aperture so that the light source is focused. At least one variable aperture control is provided for one of the apertures so that variability of that aperture area size can be performed. Fiber optic bundles coupled for each aperture which receives the focused light where each bundle contains at least one fiber optic which provides a light conduit. Each bundle is coupled to an overhead position so that there is directed in a substantially downward direction from the overhead position the bundle. The area is illuminated with a simulated constant starlight and a simulated moonlight that may be varied by varying aperture size.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
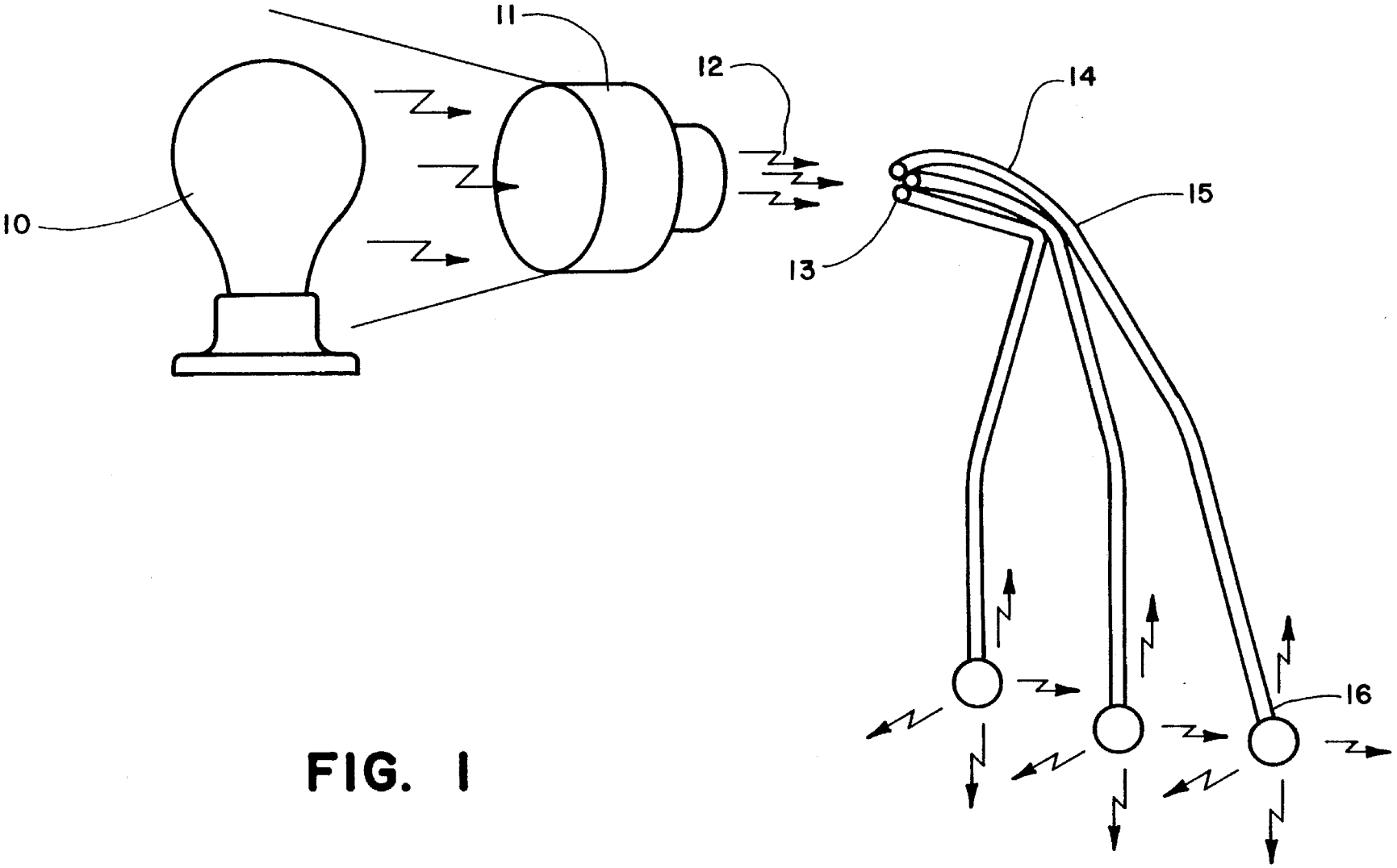
FIG. 1 is a pictorial view of the star light subassembly of the present invention.

Referring now to the drawings, and more particularly to FIG. 1, there is shown a pictorial view of the first light subassembly of the present invention. Light source 10 which is enclosed (not shown) has fixed aperture 11 through which light output 12 is illuminated onto fiber optic array input 13 of fiber optic bundle 14. It is understood that the invention is not limited to a particular light source or aperture model but that any source and aperture known in the art may be used. Fiber optic bundle 14 is coupled to an overhead structure at coupling point 15 with coupling means known in the art which allows fiber optic bundle ends 16 to point downward from the overhead structure.

The type of fiber optic used may be any that is found in the prior art as long as the fiber optic is capable of transmitting the entire infrared spectral range. The number of bundles used and their specific shape/length are varied depending on the overall desired effect that is desired. Light will be directed downward which is thus more representative of natural starlight. The light will travel through the fiber optics and the output emanating from fiber optic bundle end 16 will be disbursed by the method that the end is fabricated. That fabrication method may be by how the ends are cut which effect a wide field of view (FOV) lens. Light levels generated by the first light assembly are to simulate starlight. At each range bin in the firing range a single light source with multiple outputs will uniformly illuminate a constant starlight over a wide area.

Figure 2:
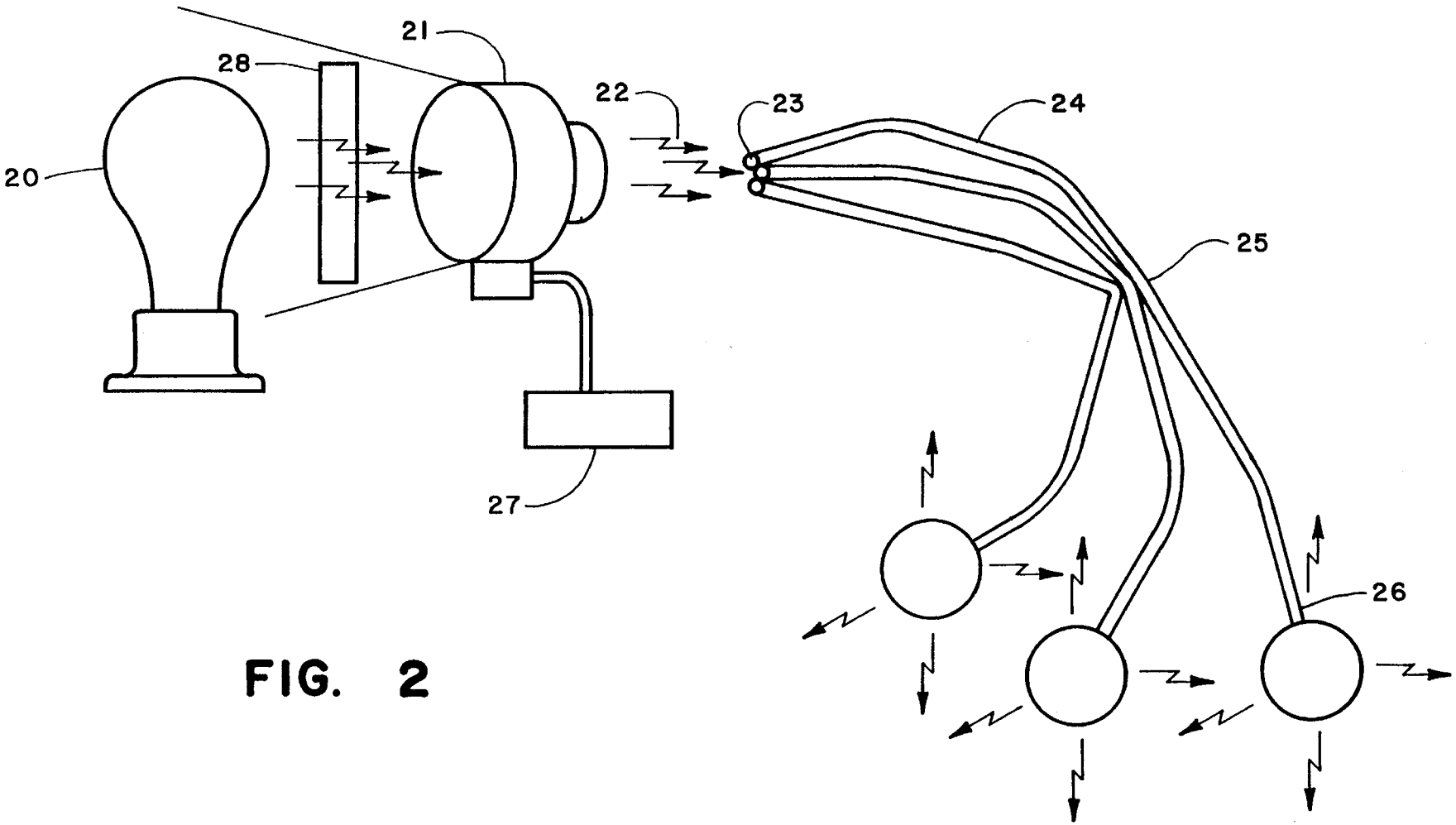
FIG. 2 is a pictorial view of the moon light subassembly of the present invention.

FIG. 2 is a pictorial view of the second light subassembly of the present invention. Light source 20 which is enclosed (not shown) has a variable aperture 21 through which light output 22 is focused onto fiber optic array input 23 of fiber optic bundle 24. Fiber optic bundle 14 is coupled to an overhead structure at coupling point 25 which allows fiber optic bundle ends 26 to point downward from the overhead structure.

The light will travel through the fiber optics and the output emanating from fiber optic bundle end 16 will be disbursed by the method that the end is fabricated. That fabrication method may include how the ends are cut which effect a wide field of view (FOV) lens. The light levels generated by the second light subassembly are to simulate moonlight illumination. Because moonlight illumination is a variable, the light levels of the second light subassembly must be varied. To vary the light levels in the second light subassembly, variable aperture 21 is remotely controlled through controller 27 which steps down the amount of light which emits from variable aperture 21. With the use of variable aperture 21 there is maintained correct color temperature and enable the user to vary illumination intensities. Optional filter wheel 28 can be used to adjust color temperature if it is determined that color temperature changes with the moon angle and phase. The filter wheel type is known in the art, and any may be used as long as the desired effect is attained.

Figure 3:
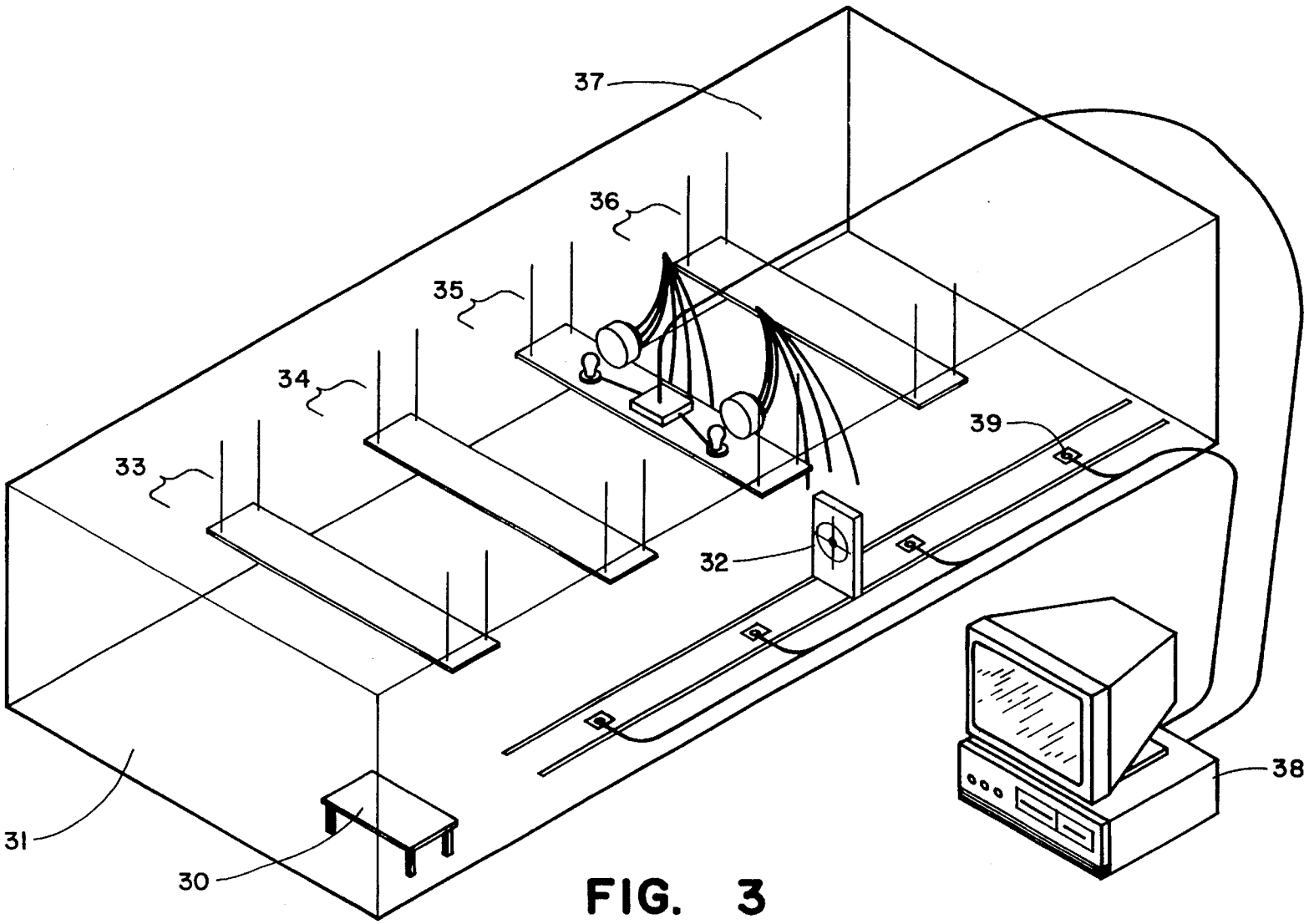
FIG. 3 is a side view of the hybrid simulation system and technique utilized in the preferred embodiment of an indoor firing range.

FIG. 3 is a side view of the hybrid simulation system and technique utilized in the field of the preferred embodiment of an indoor firing range. The indoor firing range of the preferred embodiment comprises long massively built chambers of thick walled reinforced concrete with a layer of sound absorbing material applied to the inner walls and ceiling. One or more stalls with tables, such as table 30 are usually in line across chamber back 31, defining the firing line, with targets, such as target 32 parallel to the firing line, that may be placed at varying distances along the chamber length by a track system (not shown).

Lighting platforms 33, 34, 35, and 36, each of which includes a first and second light subassembly of FIGS. 1 and 2, is shown in FIG. 3 as suspended from ceiling 37 of an indoor firing range. While the light subassemblies are shown on platform 35 of FIG. 3 it is understood that any or all platforms may contain the lighting subassemblies.

To maintain uniformity and control of illumination over the entire firing range microcomputer 38 is utilized. Microcomputer 38 includes outputs for control of first lighting subassembly, second subassembly and sensors. Illumination sensors 39 allow for feedback to microcomputer 38 for correct control of overall illumination.

Figure 4:
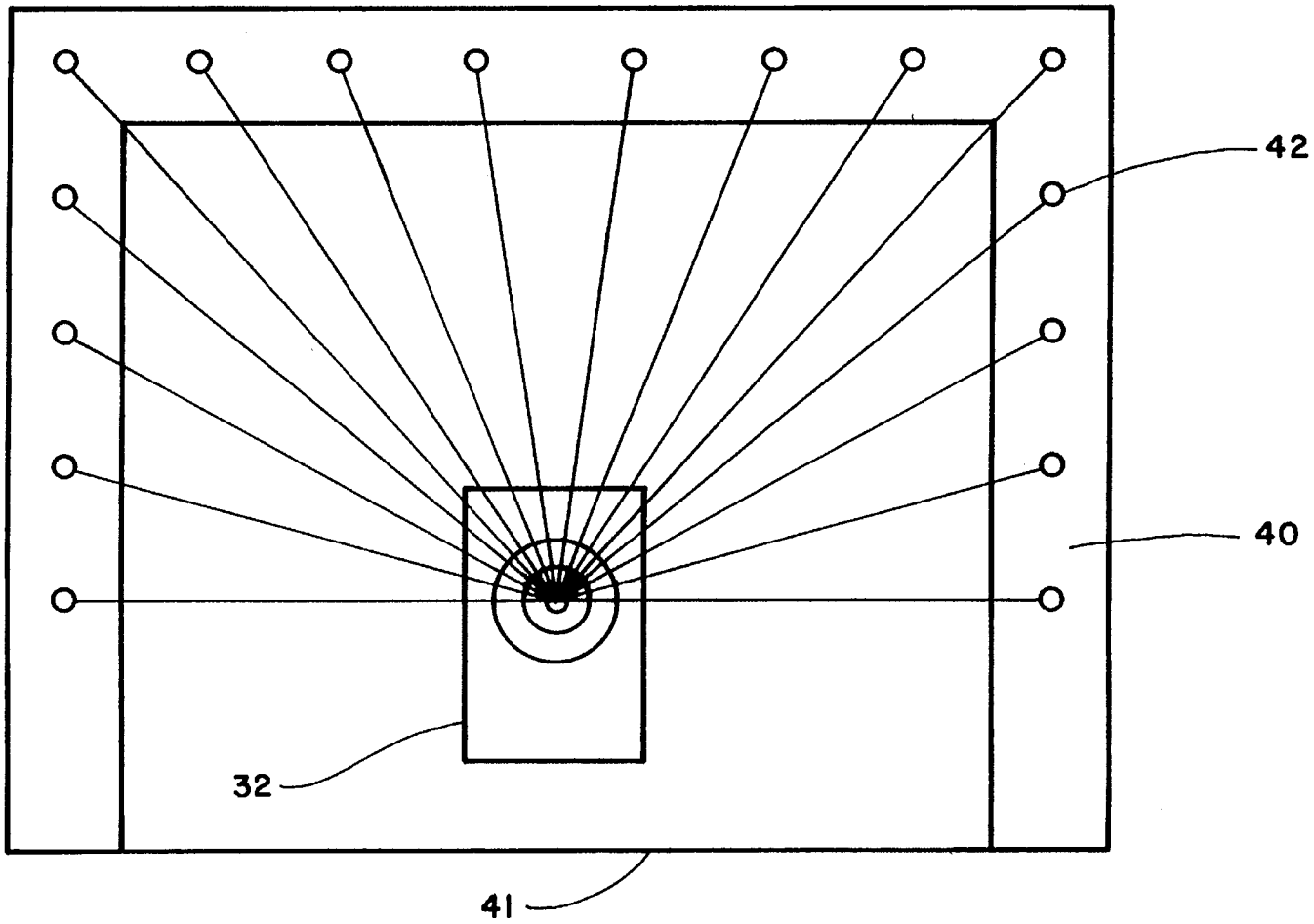
FIG. 4 is a cross-sectional front view of the indoor firing range of FIG. 3 at a target position depicting the movable lighting subassembly of the present invention.

FIG. 4 is a cross-sectional front view of the indoor firing range of FIG. 3 at a target position depicting the movable lighting subassembly of the present invention. The movable lighting subassembly is utilized to direct light at a chosen chamber cross-section for simulation of moon elevation and azimuth positions. A frame subsystem is shown including frame 40 which further includes two vertical and one horizontal sections movable along floor 41 of the firing range. Bundle ends 26 of FIG. 2 is shown as outputs 42 in FIG. 4 as positioned around frame 40 at ten degree intervals of all three sections. Frame 40 is either made any suitable strong material positioned preferredably behind proper structure which is bullet-proof.

With the selection of specific azimuth and elevation for a moon position the specific output, such as output 42 would be activated which would then provide a realistic shadow onto target 32 positioned underneath frame 40. By making frame 40 movable there can be simulated one target within a moonlight shadow while at the same time simulating a second target without a moonlight shadow. It is understood that the movable lighting subassembly is optional, such that the present invention can be practiced without use of the movable lighting assembly.

Figure 5:
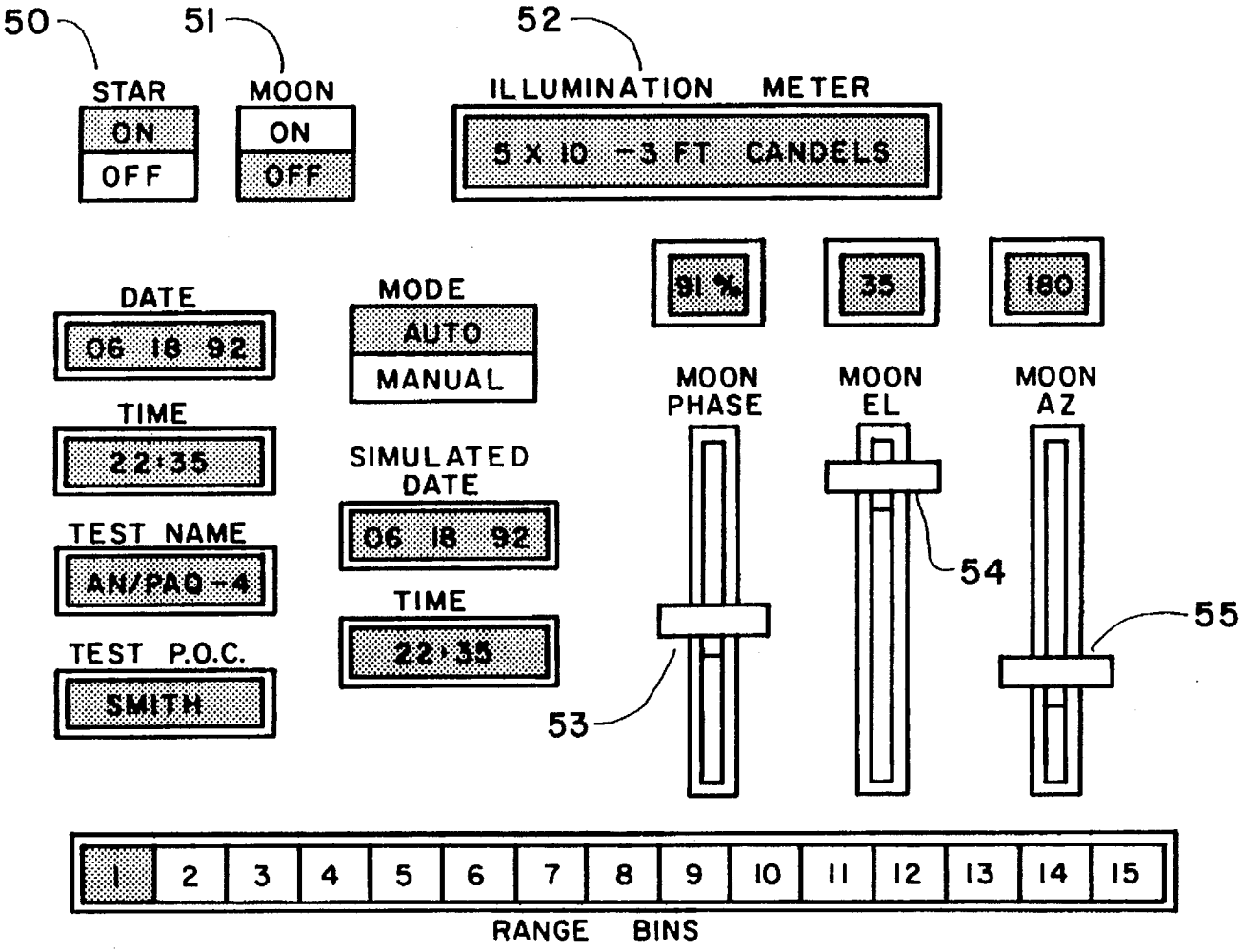
FIG. 5 is a front view of a control panel utilized with the present invention.

FIG. 5 is a front view of the control panel utilized with the present invention. Starlight and moonlight options are chosen by control elements 50 and 51 so that the simulation to be presented as a starry and moonlit night, one without a moon, or one where moonlight alone is to be represented. Illumination is set by control 52 which provides intensity options that the intensity of the light sources will be illuminated at. The moon phase in percent is imputed via control element 53 which will control the variable controller of FIG. 2 thus giving a simulation of a specific moon phase. Moon elevation and moon azimuth is set with control elements 54 and 55 which provide the information required to represent a proper elevation and azimuth simulated by the frame subsystem shown in FIG. 4. A database is utilized to keep a record of a test conduced which would include such items as date and time. Illumination levels, range bin, moon phase, and moon position data are then input along with specific test records such as time, date etc. While it is understood the field of the present invention is a firing range is understood that any enclosed environment may be utilized to be viewed with an image intensifier device. A database which that may be utilized in the present invention is described in patent application Ser. No. 08/098,988 to William M. Decker entitled "Night Vision Goggle Aided Flight Simulation" filed July 29, 1993, incorporated herein by reference (assigned to the same assignee as the present invention).

While this invention has been described in terms of preferred embodiment consisting of a hybrid simulation of starlight and moonlight, those skilled in the art will recognize that the invention can be practiced with modification within the spirit and scope of the appended claims.

Having thus described my invention, what I claim as new and desire to secure by Letters Patent is as follows:

1. A hybrid infrared (IR) simulation system for testing IR image intensifiers that provides indoor starlight and moonlight simulation in the IR spectrum for the illumination of a target to be viewed by an image intensifier under test including:

a target to be viewed by an image intensifier under test;

a first means for illuminating said target to simulate both the visible and IR spectrum of starlight;

a second means for illuminating said target to simulate both the visible and IR spectrum of moonlight;

means for selectively and independently controlling the illumination emanating from the first and second illuminating means such that the illuminating target is viewed under selected simulation starlight and moonlight conditions to specifically include the various phases, elevations and azimuth of the moon, each of said first and second target illuminating means containing at least one light source, and a fiber optic bundle means for conveying the light radiation from each respective light source to a lens means for controlling the field of view of the light radiation emanating therefrom, whereby the respective lenses means are so mounted in the enclosure as to provide the desired target illumination;

aperture means for controlling the amount of light radiation transmitted from each respective light source to the respective fiber optic bundle, to specifically include a fixed aperture means for optically coupling the light source of the first illumination means to the respective fiber optic bundle for simulating starlight, and a variably adjustable aperture means for optically coupling the light source of the second illumination means to the respective fiber optic bundle for simulating moonlight, for effecting simulated starlight and moonlight illumination of said target.

* * * * *